US007221306B2

(12) United States Patent
Young

(10) Patent No.: US 7,221,306 B2
(45) Date of Patent: May 22, 2007

(54) SYSTEM AND METHOD FOR MEASURING AND PRESENTING MEMORY SIZE OF A UNIVERSAL REMOTE CONTROL

(75) Inventor: Jeffrey J. Young, Orange, CA (US)

(73) Assignee: Universal Electronics Inc., Cypress, CA (US)

( * ) Notice: Subject to any disclaimer, the term of this patent is extended or adjusted under 35 U.S.C. 154(b) by 404 days.

(21) Appl. No.: 10/665,643

(22) Filed: Sep. 19, 2003

(65) Prior Publication Data

US 2005/0062614 A1 Mar. 24, 2005

(51) Int. Cl.
*G08C 17/02* (2006.01)

(52) U.S. Cl. ..... 341/173; 341/172; 341/274; 340/815.4; 340/815.45; 340/815.6; 348/14.05; 348/734

(58) Field of Classification Search ..... 340/870.11, 340/825.57, 825.69, 825.72, 815.45, 815.4, 340/815.6; 341/175, 173, 174, 176, 172; 369/24.01; 455/151.1, 352, 353; 348/14.05, 348/734

See application file for complete search history.

(56) References Cited

U.S. PATENT DOCUMENTS 4,959,810 A 9/1990 Darbee et al.
5,255,313 A 10/1993 Darbee
5,481,256 A 1/1996 Darbee et al.
5,515,052 A 5/1996 Darbee
5,523,800 A * 6/1996 Dudek ..... 348/734
5,537,463 A 7/1996 Escobosa et al.
5,959,751 A 9/1999 Darbee et al.
6,014,092 A 1/2000 Darbee et al.
6,195,033 B1 2/2001 Darbee et al.
6,223,348 B1 4/2001 Hayes et al.
6,611,693 B2 * 8/2003 Soini et al. ..... 455/566
6,933,833 B1 * 8/2005 Darbee ..... 341/175
2002/0077155 A1 * 6/2002 Chung ..... 455/564
2002/0162891 A1 * 11/2002 Mulla et al. ..... 235/462.49

OTHER PUBLICATIONS

Tandy Corporation, Owner's Manual: 8-IN-1 Universal Remote Control, 1990.*
Toshiba Asia, News & Press Releases: News Toshiba Launches First Notebook with Full Remote Control Multimedia Capability, Jul. 8, 2002.*

* cited by examiner

*Primary Examiner*—Jeffery Hofsass
*Assistant Examiner*—Sisay Yacob
(74) *Attorney, Agent, or Firm*—Gary R. Jarosik

(57) ABSTRACT

A system and method for measuring and presenting a size of a memory within a universal remote control. The described system and method allows a user to place a universal remote control into an operational mode wherein it measures a size of memory and reports the measured memory by means of an audio or visual indication.

32 Claims, 4 Drawing Sheets

SYSTEM AND METHOD FOR MEASURING AND PRESENTING MEMORY SIZE OF A UNIVERSAL REMOTE CONTROL

BACKGROUND

The following relates generally to remote controls and, more particularly, relates to a system and method for measuring and presenting a size of a memory in a universal remote control.

Universal remote controls, which are well-known in the art, typically offer a preprogrammed library of remote control codes corresponding to a set of standardized keys for use in commanding common operational functions, such as volume, channel, transport, etc., for each device type supported by the universal remote control, e.g., TV, VCR, DVD, etc. However, unlike a remote control that is supplied as original equipment with a device, a universal remote control is often incapable of commanding the full range of operational functions available on a device. Additionally, the library of codes pre-loaded in a universal remote control can only include support for those device types and models which were known at the time of manufacture.

To overcome these problems, universal remote controls are known which permit the addition of extended key functions and/or entire new device codes as needed. For further information regarding such features the reader is referred to U.S. Pat. No. 4,959,810 entitled "Universal Remote Control Device," U.S. Pat. No. 5,255,313 entitled "Universal Remote Control System," U.S. Pat. No. 5,537,463 entitled "Magnetic Modem in Remote Control," U.S. Pat. No. 5,515,052 entitled "Universal Remote Control with Function Synthesis," and U.S. Pat. No. 6,223,348 entitled "Universal Remote Control System," all of like assignee and all incorporated herein by reference in their entirety. In order to permit storage of this supplemental data and/or user programmable settings—such as macros (as described, for example, in U.S. Pat. No. 5,959,751 incorporated herein by reference in its entirety) or moved key functions (as described, for example, in U.S. Pat. No. 6,195,033 incorporated herein by reference in its entirety)—the memory of such a universal remote control typically includes a non-volatile read/write portion comprising EEPROM, Flash, battery-backed RAM, or the like, (collectively referred to hereinafter as "NV memory"). It will be appreciated that the NV memory allows updates and/or user programmable settings to be stored on a permanent basis through battery changes, etc.

It is also known to use a common design when manufacturing universal remote controls where the common design is capable of supporting multiple sizes of NV memory, for example, to provide for different models of universal remote controls. In the case where a common design that supports multiple sizes of NV memory is utilized, the universal remote control firmware may include an algorithm that functions to test the size of installed NV memory and, based upon the memory size, configure itself as a specific model. For example, depending upon the installed NV memory size a first model universal remote control may configure itself with full programming retention and full upgradeability while a second model universal remote control may configure itself to have only programming retention and no upgradeability. In this manner, multiple universal remote control models may be based on the same hardware/software platform and flexibly manufactured as required to match desired price point, specific application, etc.

A disadvantage of current designs, however, is that there is no convenient method to establish the exact size of the NV memory that was installed in a universal remote control. Presently, NV memory size is determined by inference (i.e., receipt of a failure message partway through an upgrading process) or by physically opening the casing of the universal remote control and inspecting the parts inside. Furthermore, there is also no convenient method for diagnosing fault conditions such as, for example, failure of a portion of an NV memory during use, or erroneous installation of the wrong size of NV memory during the manufacturing process. Accordingly a need exists for a method by which the functional size of an NV memory within a remote control may be conveniently measured and presented to a user.

SUMMARY

To address this need, among others, a system and method for measuring and presenting memory size in a remote control is hereinafter disclosed. Generally, the described system and method allows a user to place a universal remote control into an operational mode wherein it measures the size of available and/or installed NV memory and reports this to the user via an audio or visual indication. For example, to command the universal remote control to report NV memory size the user may enter one or more keystrokes which causes the universal remote control to measure a size of the NV memory and report the measured memory size via a series of LED blinks, audio sounds, or other audio/visual indicia. Thus, by counting the blinks of the LED, sequence of audio sounds, etc. the user is able to quickly and conveniently determine the measured NV memory size.

A better understanding of the objects, advantages, features, properties and relationships of the subject system and method will be obtained from the following detailed description and accompanying drawings which set forth illustrative examples which are indicative of the various ways in which the principles of the system and method may be employed.

BRIEF DESCRIPTION OF THE DRAWINGS

For a better understanding of the system and method for measuring and presenting memory size of a universal remote control, reference may be had to examples shown in the following drawings in which.

DETAILED DESCRIPTION

Figure 1:
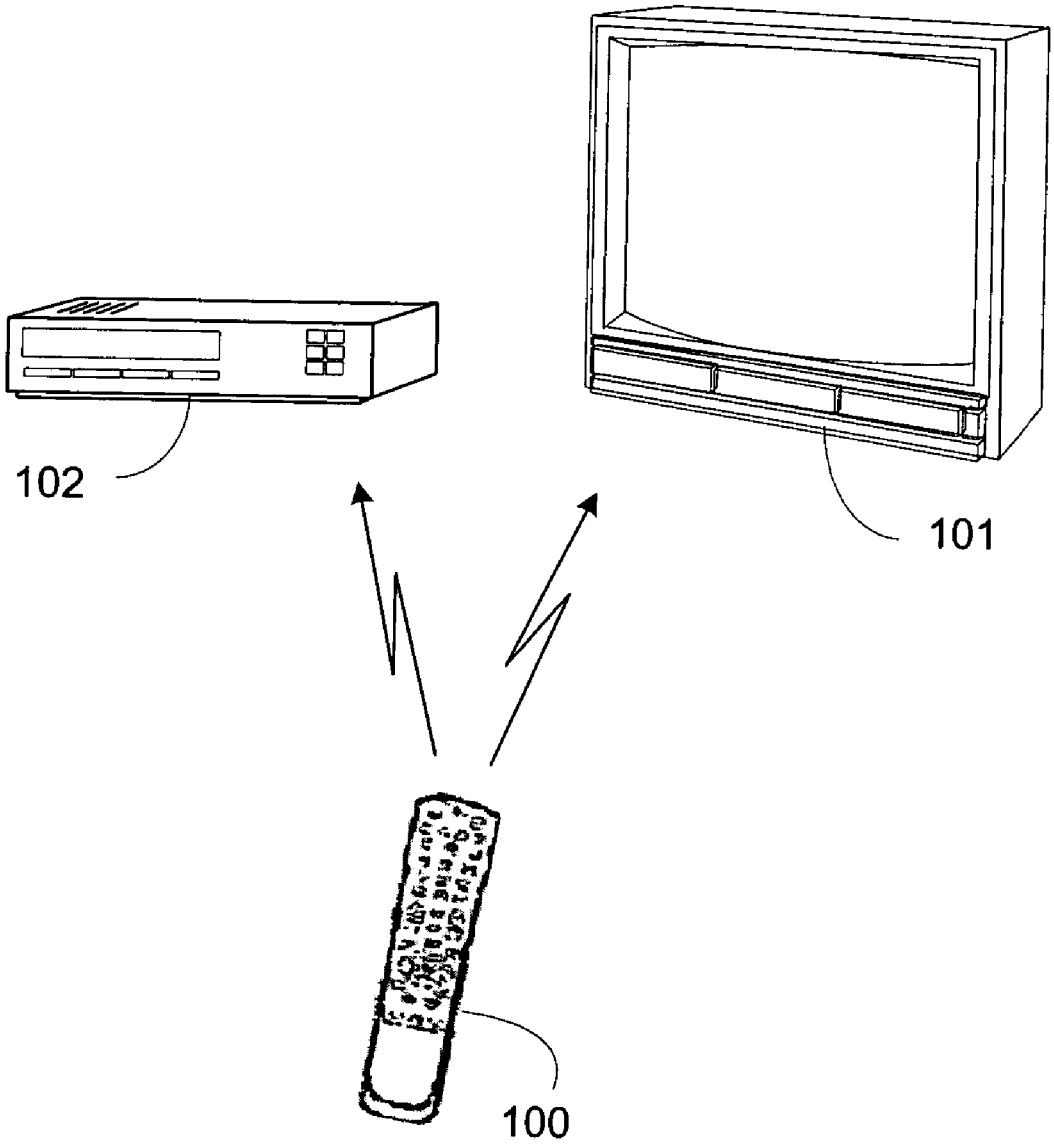
FIG. 1 illustrates an exemplary system in which the universal remote control may be used.

Turning now to the figures, wherein like reference numerals refer to like elements, there is illustrated in FIG. 1 a system in which a universal remote control 100 is usable to command operational functions of a target device. By way of example, a target device may be any type of device that is adapted to respond to commands received from the universal remote control 100, such as the illustrated TV 101 or VCR 102 as well as DVD players, CD players, cable box devices, digital video recording devices, video game devices, home theater devices, home environment devices, personal computers, etc.

Figure 2:
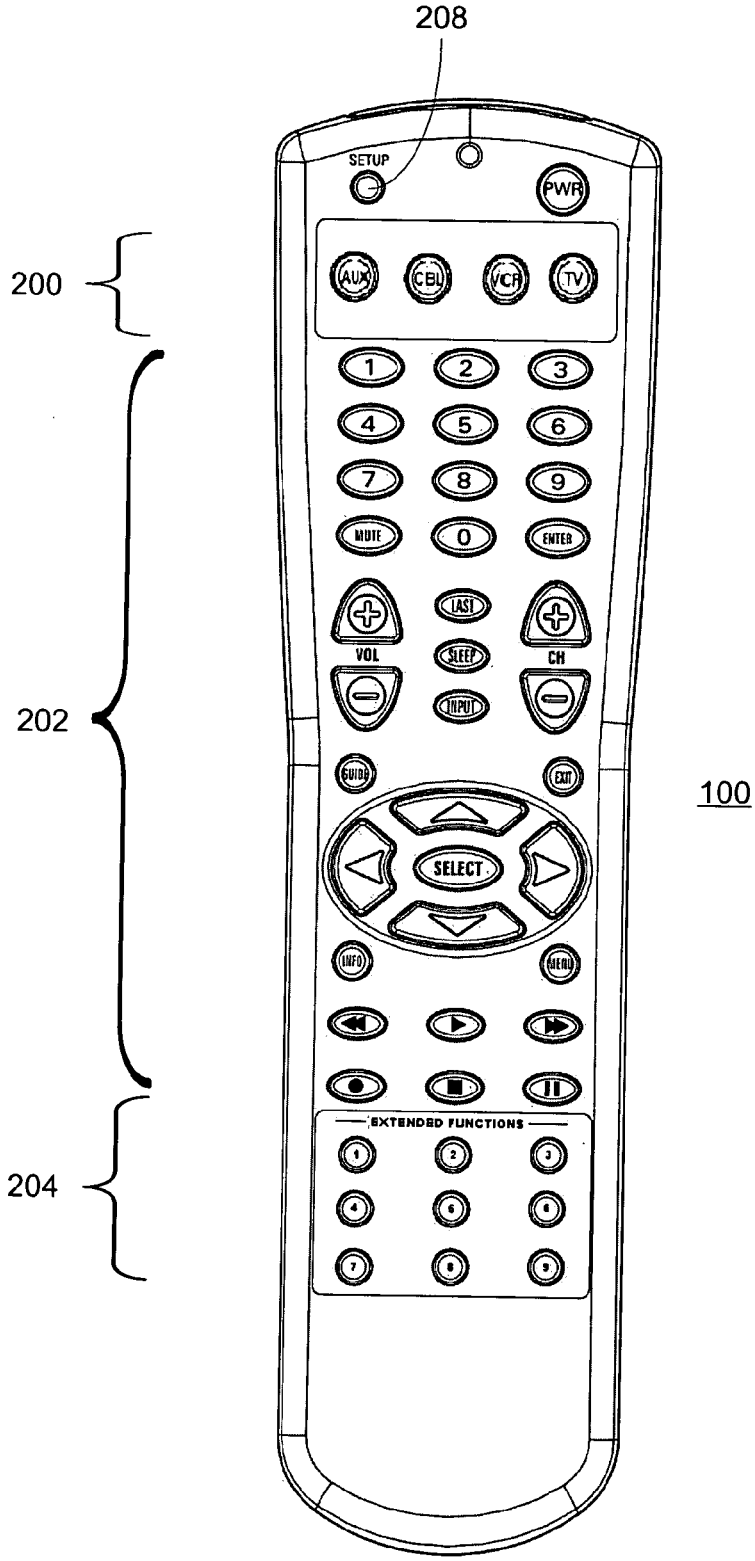
FIG. 2 illustrates a top view of an exemplary universal remote control for use in the system of FIG. 1.

In the instance where a universal remote control is adapted for use in remotely commanding a device to perform common and extended operational functions, the universal remote control 100 may include, as illustrated by way of example in FIG. 2, a standardized set of keys 202, which are typically assigned to predetermined, common operational functions, as well as a set of "extended" keys 204, provided for the purpose of being assigned extended operational functions. In this regard, common operational functions include functions which are usually included in devices of a common device type (e.g., power, digit tuning, volume control, channel up/down control, media transport, etc.) while extended operational functions include functions that are not typically supported uniformly by devices within a common device type (e.g., closed captioning, picture-in-picture control, etc). As further illustrated by way of example in FIG. 2, the universal remote control 100 may also includes device keys 200 (e.g., "aux," "cbl," "VCR," and "TV") the activation of which places the universal remote control 100 into a mode to transmit commands to a particular type of device. It will be appreciated that, while illustrated as hard keys, the keys 200, 202 and/or 204 of the universal remote control 100 may be implemented as soft keys, for example, by being displayed on an LCD touch screen or the like. Furthermore, the universal remote control 100 may include a connector placed, for example, at the rear of the unit under the battery compartment cover (not shown) through which additional device IR data codes may be loaded into the remote control from an external source.

Figure 3:
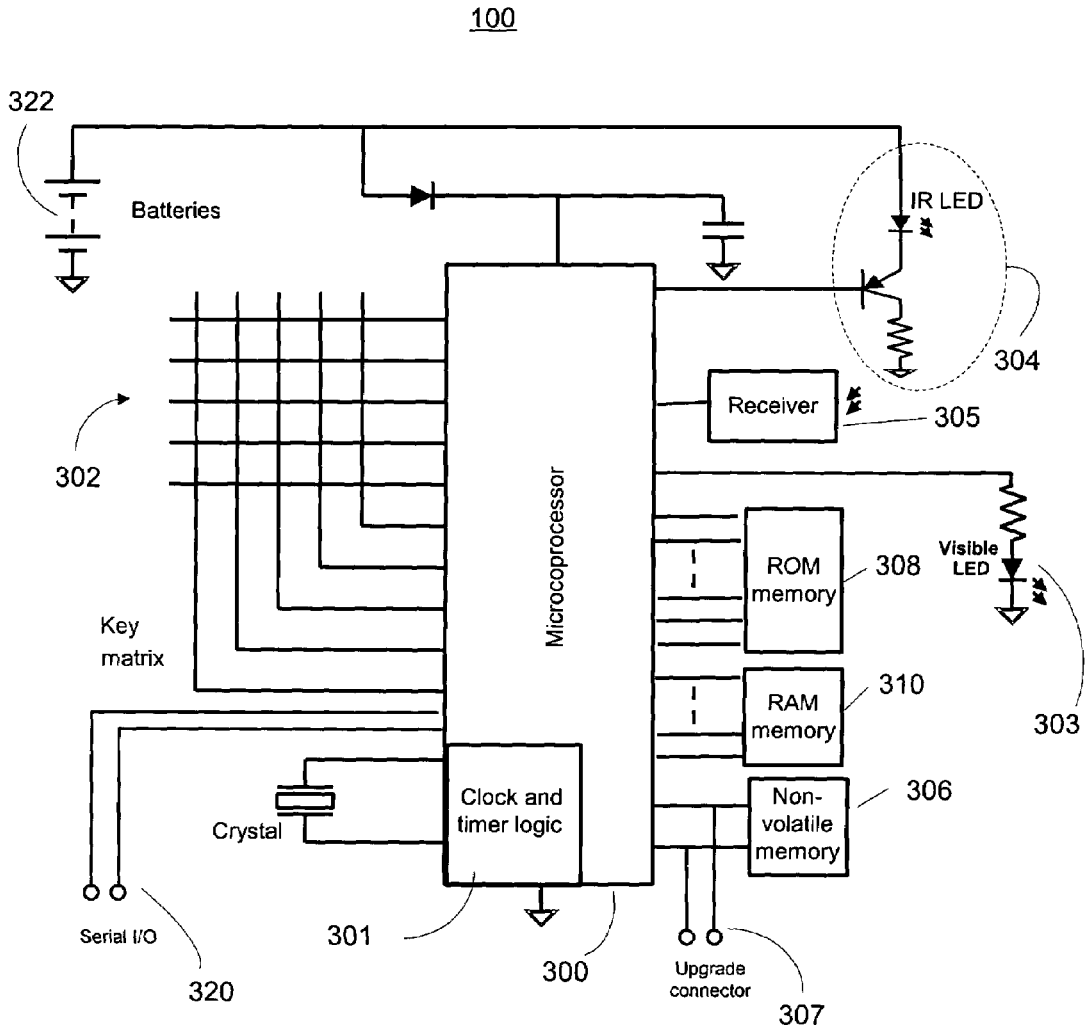
FIG. 3 illustrates a block diagram view of various components of the exemplary universal remote control of FIG. 2.

Referring now to FIG. 3, the universal remote control 100 may include, as needed for a particular application, a processor 300 coupled to one or more memory devices (such as a ROM memory 308, a RAM memory 310, and an NV memory 306), a key matrix 302 (e.g., physical buttons, a touch screen display, or a combination thereof), an internal clock and timer 301, transmission circuit(s) 304 (e.g., IR and/or RF), receiver circuit(s) 305 (e.g., IR and/or RF)—it will be understood that in some applications transmitter(s) 304 and receiver(s) 305 may be combined as a single transceiver circuit(s), and, as such, they are shown separately in FIG. 3 simply for the sake of clarity—a means 303 to provide visual feedback to the consumer (e.g., LED, display, and/or the like), means to provide audio feedback to the user (e.g., a speaker—not illustrated), a power supply 322, serial I/O port 320 (e.g., a jack or contacts), direct input/output connection to the NV memory 307, and a bar code scanner (not illustrated—but which may be provided as a means for entering data, such as device setup codes, into the universal remote control 100). As will be understood by those of skill in the art, the memory device(s) include executable instructions that are intended to be executed by the processor 300 to control the operation of the universal remote control 100. In this manner, the processor 300 may be programmed to control the various electronic components within the universal remote control 100, e.g., to monitor the power supply 322, to cause the transmission of signals, display icons and/or HTML pages, etc.

The NV memory 306, for example, an EEPROM or the like, may be provided to store setup data and parameters as necessary such that data is not required to be reloaded after battery changes. By way of illustration, the NV memory 306 may be used to store supplemental key data and/or IR codes which may be added from time to time as necessitated by new devices entering the marketplace. It will be understood that such supplemental key data and/or IR codes may be loaded into the universal remote control 100 via the direct connection to the NV memory 307, via the serial port 320, via IR or RF receiver(s) 305, or via other means such as magnetic modem coupling (not illustrated), bar code, etc. It is to be additionally understood that the memory devices may take the form of any type of readable media, such as, for example, a Smart Card, memory stick, a chip, a hard disk, a magnetic disk, and/or an optical disk. Still further, it will be appreciated that some or all of the illustrated memory devices may be physically incorporated within the same IC chip as the microprocessor 300 (a so called "microcontroller") and, as such, they are shown separately in FIG. 3 only for the sake of clarity.

To cause the universal remote control 100 to perform an action, the universal remote control 100 is adapted to be responsive to events, such as a sensed consumer interaction with the key matrix 302, receipt of a transmission, etc. In response to an event appropriate instructions and/or data within the memory devices are executed and/or accessed. For example, when a command key is activated on the universal remote control 100, the universal remote control 100 may retrieve a code data value corresponding to the activated command key from a memory device and access instructions to transmit the retrieved code data value to a device in a format recognizable by the device. It will be appreciated that the instructions within the memory devices can be used not only to cause the transmission of command codes and/or data to the devices but also to perform local operations. While not limiting, local operations that may be performed by the universal remote control 100 include setting up the remote control to operate specific items of equipment (e.g., a "Sony" brand TV set or a "Panasonic" brand VCR), favorite channel setup, macro button setup, command function key relocation, etc. Since examples of local operations can be found in U.S. Pat. Nos. 5,481,256, 5,959,751, and 6,014,092 they will not be discussed in greater detail herein. A still further local operation, described hereinafter, allows the user to request and display a report representative of a measured size of the NV memory.

To allow the user to determine a size of the NV memory, the universal remote control 100 is adapted to be response to a predetermined "test memory" command. By way of example only, the predetermined "test memory" command may be supplied to the universal remote control 100 by activating one or more predetermined keys on the universal remote control keypad (e.g., a key to place the universal remote control 100 into a setup mode and then one or more keys, such as the key sequence "9," "7," and "8" to initiate a test memory procedure as part of the setup mode). It will be appreciated that the universal remote control 100 may also have a single key or switch that is designated for activation to initiate a memory test procedure, which key or switch may be located either on the face of the universal remote control 100 or in an inconspicuous location such as inside the battery compartment.

To measure the size of the NV memory once the memory test procedure has been initiated, one or more methods well known in the art may be utilized. For example, the memory test procedure may write a sequence of incrementing one-byte numeric values at each memory page boundary—0, 128, 256, 384, 512 etc.—and then read back the values to determine which values remain valid. In cases where the NV memory is already in use, the above described algorithm may first retrieve and save any existing data values in those memory locations, for example in local scratch RAM, in order to restore the NV memory contents to their original state upon completion of the test. While this provides one example method for measuring a size of the NV memory, it will be appreciated that various other algorithms may be better matched to specific memory hardware architectures.

Figure 4:
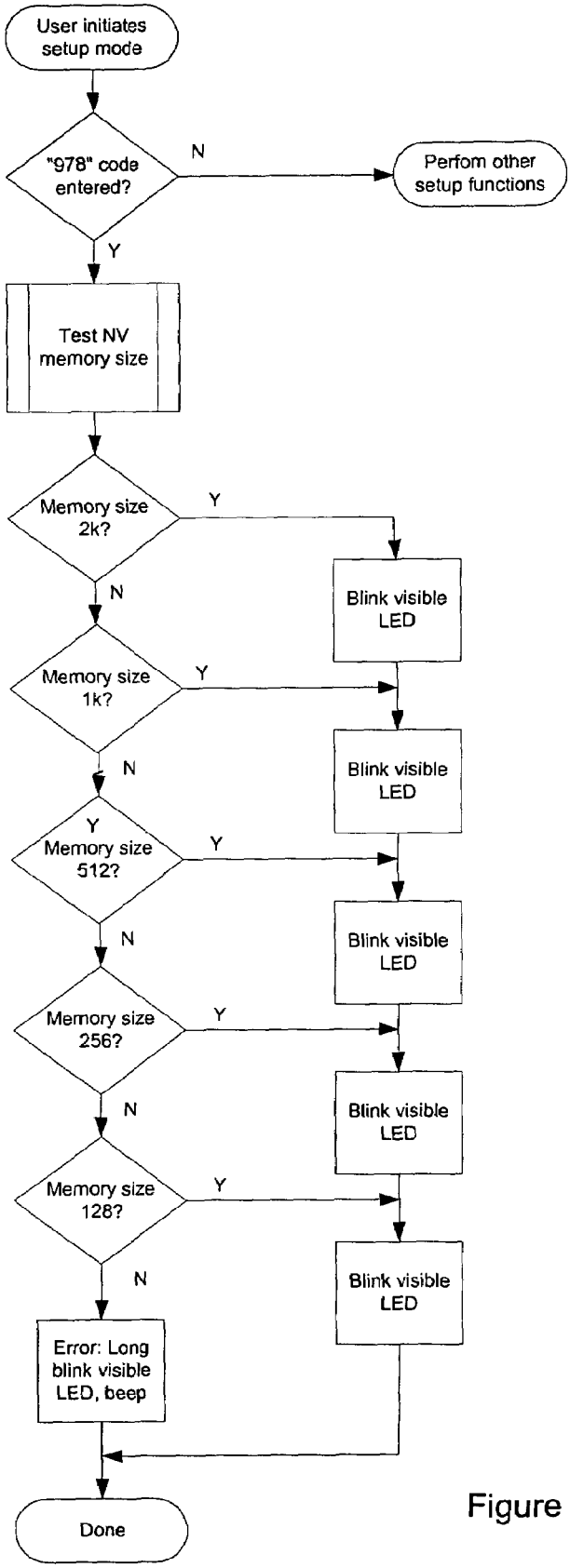
FIG. 4 illustrates an exemplary method for measuring and presenting the size of a memory in a universal remote control.

Once the memory test procedure measures a size of the NV memory, the memory test procedure may display the measured memory size to the user as further illustrated in the flowchart of FIG. 4. In this example, the user may first place the universal remote control into a setup mode by, for example, pressing and holding a setup key 208, and then enter the number sequence "9," "7," and "8" to indicate that a test memory procedure is to be conducted. As illustrated in the example of FIG. 4, a measured NV memory size of 128 bytes could be represented by the LED blinking once, a measured NV memory size of 256 bytes could be represented by the LED blinking twice, a measured NV memory size of 512 bytes could be represented by the LED blinking three times, etc. The LED may also be used to indicate the numeric value of the measured memory size by blinking a first number of times to signify the number in the first digit of the measured NV memory size, a second number of times to signify the number in the second digit of the measured NV memory size, a third number of times to signify the number in the third digit of the measured NV memory size, and so on. The displaying of the measured memory size may also be accomplished by displaying the actual numeric values of the measured memory size in a LCD display, or the like. In this context it will be appreciated by those skilled in the art that the numeric values used for above-described readout methods are not intended to be limited to a base 10 numbering system—by way of example only, a base 8 (octal) or a base 16 (hexadecimal) numbering system may be used instead. Still further, the measured memory size may be presented by activating an audible output device to produce a series of beeps using the same indicating schemes described previously with respect to provide visual indications via use of an LED. Yet further, a unique sound may also be provided to correspond to a unique, predetermined memory size (e.g., a first tone for 256, a second tone for 512, a third tone for 1K, etc.). It will be appreciated that in remote controls having voice activation or voice prompting capabilities (generally the ability to produce or emulate a voice based the playback of pre-recorded or synthesized sounds), which are well known in the art, the individual numeric values or the entire measured memory size may be read out to a user from the remote control using an audible voice.

In certain cases it will be appreciated that it may be desirable to provide the user with two separate commands that may be provided to the universal remote control 100 (e.g. activating the key sequences "9-7-8" or "9-7-9" when in the setup mode) where one command is utilized to request that the universal remote control 100 provide an indication of total installed NV memory size and the other command is utilized to request that the universal remote control provide an indication of unused NV memory space (i.e., free remaining). The latter commandable procedure is of use, for example, in allowing a user to determine, prior to attempting an upgrade, if the desired additional IR codes will fit in available NV memory. In this case, it may also be desirable that the NV memory remaining space display algorithm be automatically invoked as a first step whenever the user indicates a desire to initiate a download request.

While various embodiments of a system and method for measuring and presenting a memory size of a universal remote control have been described in detail, it will be appreciated by those skilled in the art that various modifications and alternatives to those details could be developed in light of the overall teachings of the disclosure. Accordingly, it will be understood that the particular arrangements and procedures disclosed are meant to be illustrative only and not limiting as to the scope of the invention which is to be given the full breadth of the appended claims and any equivalents thereof.

What is claimed is:

1. A method for presenting a size of a writeable memory within a universal remote control, comprising:

invoking a diagnostic routine within the universal remote control which measures a size of the writeable memory; and causing an LED of the universal remote control to blink one of a predetermined number of times each being correlated to a different measurable memory size to thereby present an indication of the size of the writeable memory as measured by the diagnostic routine.

2. A method for presenting a size of a writeable memory within a universal remote control, comprising:

invoking a diagnostic routine within the universal remote control which measures a size of the writeable memory; and causing an LED of the universal remote control to be blinked in at least one group of blinks, the group of blinks corresponding to one or more digits representative of measured memory size, to thereby present an indication of the size of the writeable memory as measured by the diagnostic routine.

3. A method for presenting a size of a writeable memory within a universal remote control, comprising:

invoking a diagnostic routine within the universal remote control which measures a size of the writeable memory; and causing a speaker of the universal remote control to emit a sound one of a predetermined number of times each being correlated to a different measurable memory size to thereby present an indication of the size of the writeable memory as measured by the diagnostic routine.

4. A method for presenting a size of a writeable memory within a universal remote control, comprising:

invoking a diagnostic routine within the universal remote control which measures a size of the writeable memory; and causing a speaker of the universal remote control to emit at least one group of sounds, the group of sounds corresponding to one or more digits representative of measured memory size, to thereby present an indication of the size of the writeable memory as measured by the diagnostic routine.

5. The method as recited in claim 1, wherein the memory size measured is an overall size of the writeable memory.

6. The method as recited in claim 1, wherein the memory size measured is an amount of available memory in the writeable memory.

7. The method as recited in claim 1, wherein the diagnostic routine is automatically invoked in response to a request to download data into the writeable memory.

8. A readable medium carrying processor executable instructions for presenting a size of a writeable memory within a universal remote control, the instructions performing steps comprising:

invoking a diagnostic routine within the universal remote control which measures a size of the writable memory; and causing an LED of the universal remote control to blink one of a predetermined number of times each being correlated to a different measurable memory size to thereby present an indication of the size of the writeable memory as measured by the diagnostic routine.

9. A readable medium carrying processor executable instructions for presenting a size of a writeable memory within a universal remote control, the instructions performing steps comprising:

invoking a diagnostic routine within the universal remote control which measures a size of the writable memory; and causing an LED of the universal remote control to be blinked in at least one group of blinks, the group of blinks corresponding to one or more digits representative of measured memory size, to thereby present an indication of the size of the writeable memory as measured by the diagnostic routine.

10. A readable medium carrying processor executable instructions for presenting a size of a writeable memory within a universal remote control, the instructions performing steps comprising:

invoking a diagnostic routine within the universal remote control which measures a size of the writable memory; and causing a speaker to emit a sound one of a predetermined number of times each being correlated to a different measurable memory size to thereby present an indication of the size of the writeable memory as measured by the diagnostic routine.

11. A readable medium carrying processor executable instructions for presenting a size of a writeable memory within a universal remote control, the instructions performing steps comprising:

invoking a diagnostic routine within the universal remote control which measures a size of the writable memory; and causing a speaker to emit at least one group of sounds, the group of sounds corresponding to one or more digits representative of measured memory size, to thereby present an indication of the size of the writeable memory as measured by the diagnostic routine.

12. The readable medium as recited in claim 8, wherein the measured memory size is an overall size of the writeable memory.

13. The readable medium as recited in claim 8, wherein the measured memory size is an amount of available memory in the writeable memory.

14. The readable medium is recited in claim 8, wherein the diagnostic routine is automatically invoked in response to a request to download data into the writeable memory.

15. The method as recited in claim 2, wherein the memory size measured is an overall size of the writeable memory.

16. The method as recited in claim 2, wherein the memory size measured is an amount of available memory in the writeable memory.

17. The method as recited in claim 2, wherein the diagnostic routine is automatically invoked in response to a request to download data into the writeable memory.

18. The method as recited in claim 3, wherein the memory size measured is an overall size of the writeable memory.

19. The method as recited in claim 3, wherein the memory size measured is an amount of available memory in the writeable memory.

20. The method as recited in claim 3, wherein the diagnostic routine is automatically invoked in response to a request to download data into the writeable memory.

21. The method as recited in claim 4, wherein the memory size measured is an overall size of the writeable memory.

22. The method as recited in claim 4, wherein the memory size measured is an amount of available memory in the writeable memory.

23. The method as recited in claim 4, wherein the diagnostic routine is automatically invoked in response to a request to download data into the writeable memory.

24. The readable media as recited in claim 9, wherein the memory size measured is an overall size of the writeable memory.

25. The readable media as recited in claim 9, wherein the memory size measured is an amount of available memory in the writeable memory.

26. The readable media as recited in claim 9, wherein the diagnostic routine is automatically invoked in response to a request to download data into the writeable memory.

27. The readable media as recited in claim 10, wherein the memory size measured is an overall size of the writeable memory.

28. The readable media as recited in claim 10, wherein the memory size measured is an amount of available memory in the writeable memory.

29. The readable media as recited in claim 10, wherein the diagnostic routine is automatically invoked in response to a request to download data into the writeable memory.

30. The readable media as recited in claim 11, wherein the memory size measured is an overall size of the writeable memory.

31. The readable media as recited in claim 11, wherein the memory size measured is an amount of available memory in the writeable memory.

32. The readable media as recited in claim 11, wherein the diagnostic routine is automatically invoked in response to a request to download data into the writeable memory.

* * * * *